US009702205B2

(12) United States Patent
Jansen et al.

(10) Patent No.: US 9,702,205 B2
(45) Date of Patent: Jul. 11, 2017

(54) OFFSHORE WELL SYSTEM WITH CONNECTION SYSTEM

(71) Applicant: Cameron International Corporation, Houston, TX (US)

(72) Inventors: Ivar Magnus Jansen, Kristiansand (NO); Glenn Thore Saebø, Kristiansand (NO)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/382,755

(22) PCT Filed: Nov. 21, 2013

(86) PCT No.: PCT/US2013/071160
§ 371 (c)(1),
(2) Date: Sep. 3, 2014

(87) PCT Pub. No.: WO2014/171974
PCT Pub. Date: Oct. 23, 2014

(65) Prior Publication Data

US 2016/0230480 A1 Aug. 11, 2016

(30) Foreign Application Priority Data

Apr. 19, 2013 (NO) ..... 20130546

(51) Int. Cl.
*E21B 19/00* (2006.01)
*E21B 17/01* (2006.01)

(52) U.S. Cl.
CPC ..... *E21B 19/004* (2013.01); *E21B 17/01* (2013.01); *E21B 19/002* (2013.01); *E21B 19/006* (2013.01)

(58) Field of Classification Search
CPC ..... E21B 17/01; E21B 17/085; E21B 19/004; E21B 19/006
See application file for complete search history.

(56) References Cited

U.S. PATENT DOCUMENTS 4,102,146 A * 7/1978 Dietrich ..... F16L 1/26 166/343
4,423,984 A * 1/1984 Panicker ..... E21B 17/015 166/344

(Continued)

FOREIGN PATENT DOCUMENTS

WO 2012065896 A2 5/2012

OTHER PUBLICATIONS

International Search Report and Written Opinion dated Mar. 14, 2014 for PCT Application No: PCT/US2013/071160 filed on Nov. 21, 2013.

(Continued)

*Primary Examiner* — Matthew R Buck
*Assistant Examiner* — Aaron Lembo
(74) *Attorney, Agent, or Firm* — Chamberlain Hrdlicka

(57) ABSTRACT

A connection system for connecting a structure fluid line on an offshore structure with a riser fluid line on a subsea riser. The system includes a connector attachable to the subsea riser and a gooseneck comprising a gooseneck connector in fluid communication with the structure fluid line. A frame is supportable on the connector and comprises a slide releasably engageable with the gooseneck and moveable within the frame. The slide is remotely controllable to move the gooseneck connector into and out of a connected position to establish or break fluid communication between the structure fluid line and the riser fluid line.

17 Claims, 12 Drawing Sheets

(56) References Cited

U.S. PATENT DOCUMENTS

| | | | | |
|---|---|---|---|---|
| 4,448,568 | A * | 5/1984 | Gentry | B63B 22/021 166/345 |
| 4,661,017 | A * | 4/1987 | Wood | E21B 43/013 405/169 |
| 4,668,126 | A | 5/1987 | Burton | |
| 5,553,668 | A * | 9/1996 | Council | E21B 19/22 166/77.3 |
| 5,845,708 | A | 12/1998 | Burge et al. | |
| 6,116,345 | A * | 9/2000 | Fontana | B65H 75/22 166/343 |
| 7,040,393 | B2 * | 5/2006 | Adams | E21B 33/038 166/77.51 |
| 7,264,057 | B2 * | 9/2007 | Rytlewski | B63G 8/001 166/338 |
| 8,267,179 | B2 * | 9/2012 | Butcher | E21B 43/0107 166/341 |
| 8,961,069 | B2 * | 2/2015 | Long | E21B 41/0014 166/338 |
| 9,175,525 | B2 * | 11/2015 | Faye | E21B 17/02 |
| 9,328,569 | B2 * | 5/2016 | Gilmore | E21B 19/006 |
| 2011/0056701 | A1 | 3/2011 | Jones et al. | |
| 2011/0101682 | A1 | 5/2011 | Vatne | |
| 2012/0318517 | A1 | 12/2012 | Christensen et al. | |
| 2012/0325486 | A1 | 12/2012 | Gilmore et al. | |
| 2013/0092388 | A1 | 4/2013 | Gilmore et al. | |

OTHER PUBLICATIONS

Norwegian Search Report dated Oct. 1, 2013 for Norwegian Patent Application No. 20130546 filed Apr. 19, 2013.

* cited by examiner

OFFSHORE WELL SYSTEM WITH CONNECTION SYSTEM

CROSS-REFERENCE TO RELATED APPLICATIONS

This application is a National Stage of International Application No. PCT/US2013/071160, filed Nov. 21, 2013, which claims priority to Norwegian Application No. 20130546, filed Apr. 19, 2013.

BACKGROUND

The size and weight of the riser joints, and the location of the attachment points of the auxiliary lines to the joints makes installation and/or retrieval of the auxiliary lines a labor-intensive process. Consequently, auxiliary line handling operations can be time consuming and costly. Embodiments of the present disclosure include a gooseneck conduit system that reduces handling time and enhances operational safety. Embodiments of the conduit system disclosed herein can provide simultaneous connection of gooseneck conduits to a plurality of auxiliary fluid lines with no requirement for manual handling or connection operations. Embodiments include hydraulically and/or mechanically operated locking mechanisms that secure the conduit system to the telescoping joint and the auxiliary fluid lines. The conduit system may be hoisted into position on the telescoping joint, and attached to the telescoping joint and the auxiliary fluid lines via the provided locking mechanisms. Thus, embodiments allow gooseneck conduits to be quickly and safely attached to and/or removed from the telescoping joint.

BRIEF DESCRIPTION OF THE DRAWINGS

For a detailed description of the preferred embodiments of the invention, reference will now be made to the accompanying drawings in which.

DETAILED DESCRIPTION

Figure 1A:
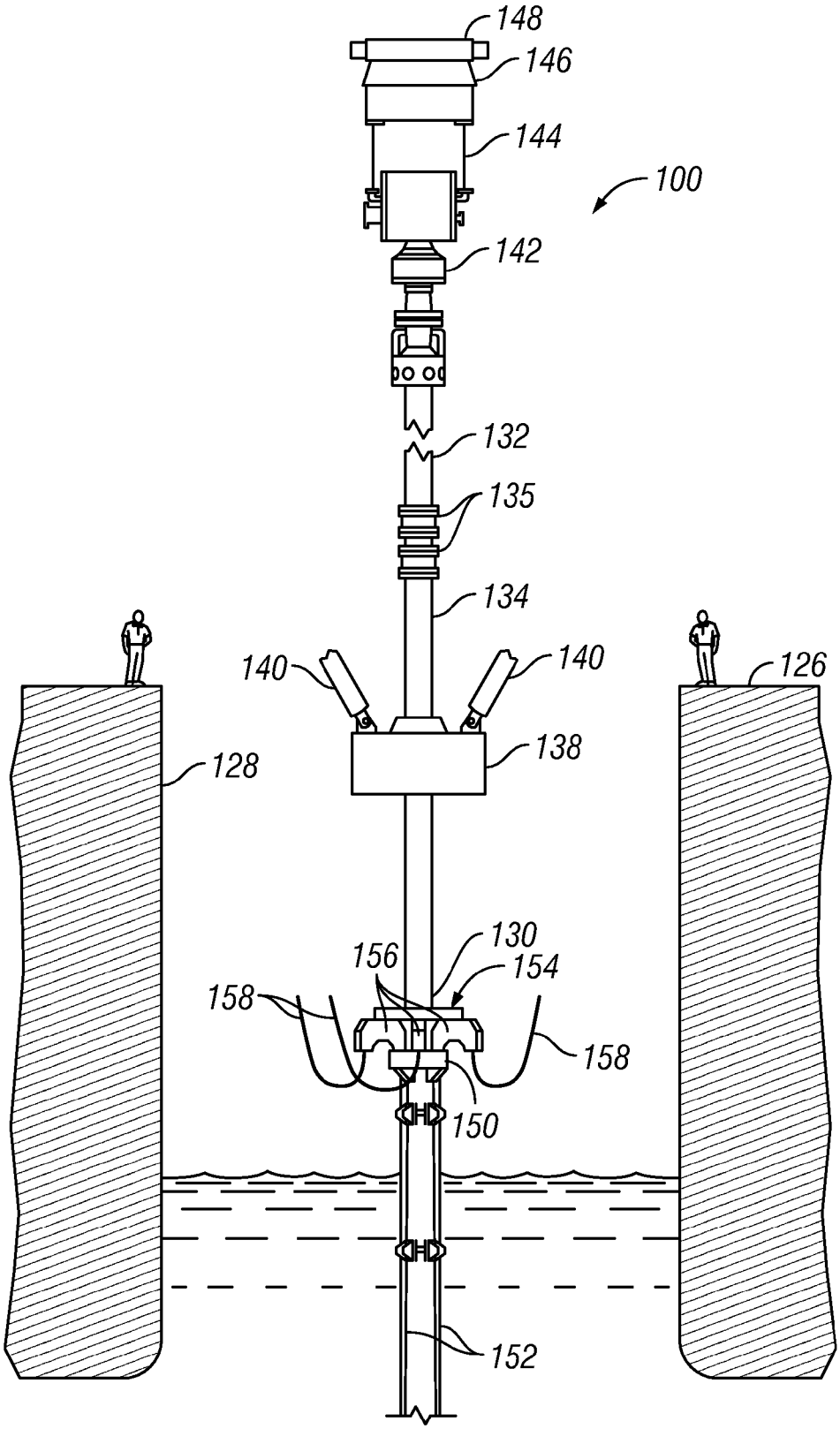
FIGS. 1A and 1B show a drilling system including a gooseneck conduit system in accordance with various embodiments.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Figure 1B:
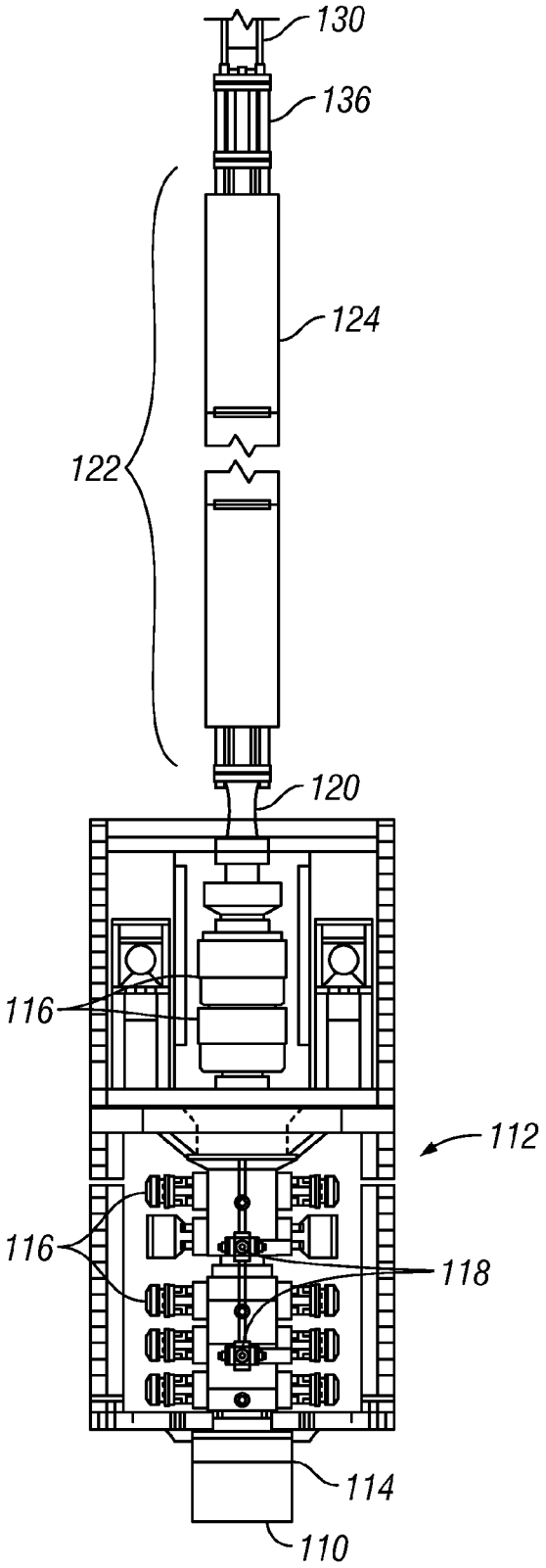

FIGS. 1A and 1B show a drilling system 100 in accordance with various embodiments. The drilling system 100 includes a drilling rig 126 with a riser string 122 and a blowout preventer stack 112 used in oil and gas drilling operations connected to a wellhead housing 110. The wellhead housing 110 is disposed on the ocean floor with the blowout preventer stack 112 connected by a hydraulic connector 114. The blowout preventer stack 112 includes multiple blowout preventers 116 and kill and choke valves 118 in a vertical arrangement to control well bore pressure in a manner known to those of skill in the art. Disposed on the upper end of blowout preventer stack 112 is a riser adapter 120 to allow connection of the riser string 122 to the blowout preventer stack 112. The riser string 122 is composed of multiple sections of pipe or riser joints 124 connected end to end and extending upwardly to the drilling rig 126.

The drilling rig 126 further includes a moon pool 128 including a telescoping joint 130 disposed therein. The telescoping joint 130 includes an inner barrel 132 that telescopes inside an outer barrel 134 to allow relative motion between the drilling rig 126 and the wellhead housing 110 while maintaining the riser string 122 in tension. A dual packer 135 is disposed at the upper end of the outer barrel 134 and seals against the exterior of the inner barrel 132. A landing tool adapter joint 136 is connected between the upper end of the riser string 122 and the outer barrel 134 of the telescoping joint 130. A tension ring 138 is secured on the exterior of the outer barrel 134 and connected by tension lines 140 to a hydraulic tensioning system as known to those skilled in the art. This arrangement allows tension to be applied by the hydraulic tensioning system to the tension ring 138 and the telescoping joint 130. The tension is transmitted through the landing tool adapter joint 136 to the riser string 122 to support the riser string 122. The upper end of the inner barrel 132 is terminated by a flex joint 142 and a diverter 144 connecting to a gimbal 146 and a rotary table spider 148.

A support collar 150 is coupled to the telescoping joint 130, and the auxiliary fluid lines 152 are connected using seal sub systems (described in detail below) and retained by the support collar 150. One or more gooseneck conduit assemblies 154 are coupled to the support collar 150 and to the auxiliary fluid lines 152 via the seal sub systems retained by the support collar 150. Each conduit assembly 154 is a conduit unit that includes one or more gooseneck conduits 156. A hose 158 or other fluid line is connected to each gooseneck conduit 156 for transfer of fluid between the gooseneck conduit 156 and the drilling rig 126. In some embodiments, the connections between the hoses 158 and/or other rig fluid lines and the gooseneck conduits 156 are made on the rig floor, and thereafter the gooseneck conduit assemblies 154 are lowered onto the telescoping joint 130. The conduit assemblies 154 can be lowered onto the support collar 150 using a crane or hoist.

Figure 2:
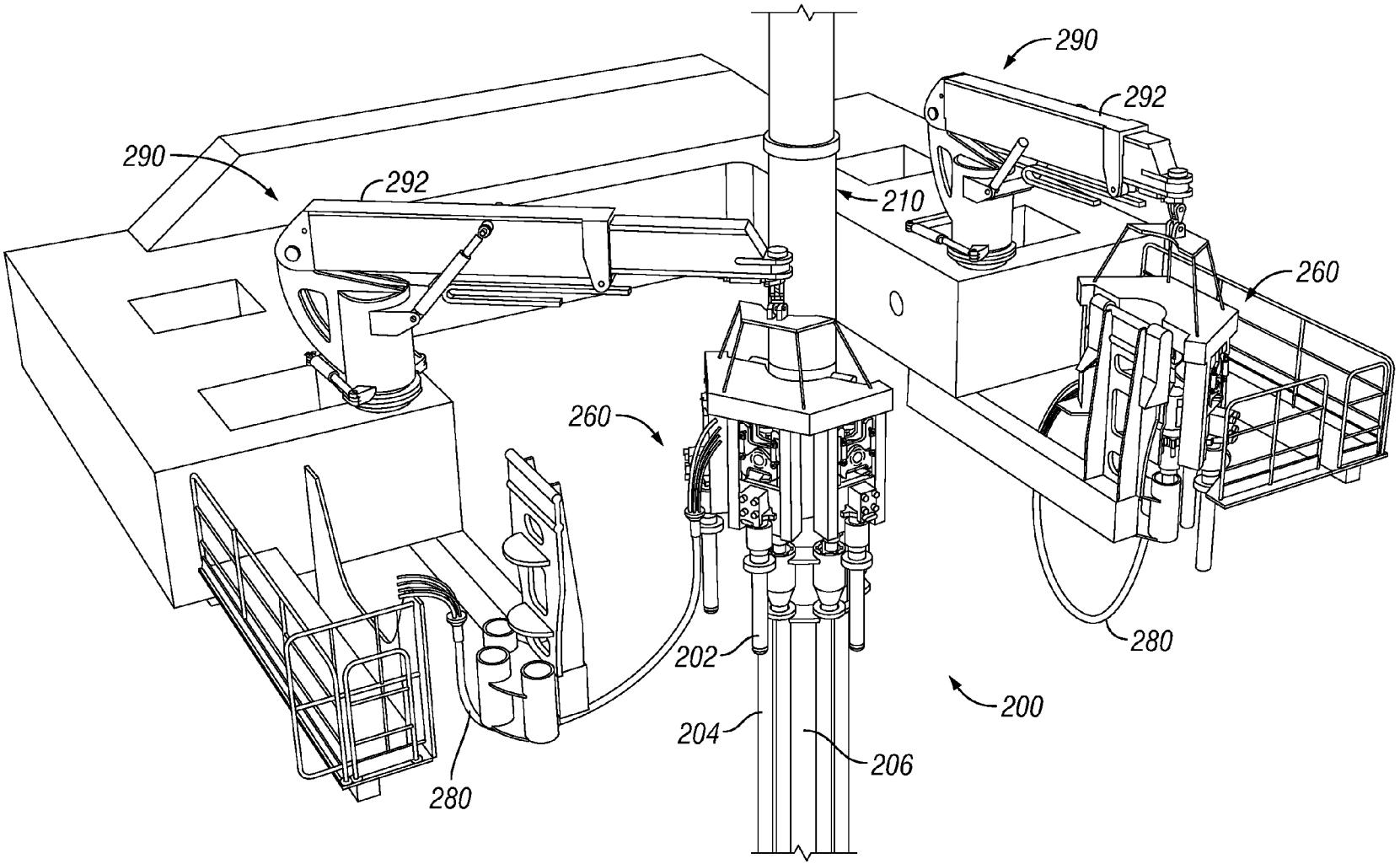
FIG. 2 shows an embodiment of a connection system.

FIG. 2 shows an overview of an embodiment of a connection system 200 for connecting a structure fluid line 202 on an offshore structure, such as a drape hose on a drilling rig, with a riser fluid line 204 on a subsea riser 206, such as an auxiliary line. The structure fluid lines 202 are not completely shown in FIG. 2 and should be understood to extend to equipment on the offshore structure. Only part of the offshore structure is shown in FIG. 2. In this embodiment the only structure shown is a blowout preventer (BOP) trolley. However, the connection system 200 may be installed on any other suitable structure as well. The riser fluid line 204 may be any auxiliary fluid line, such as a choke/kill line, a boost line, hydraulic line, or any other type of fluid line.

Figure 3:
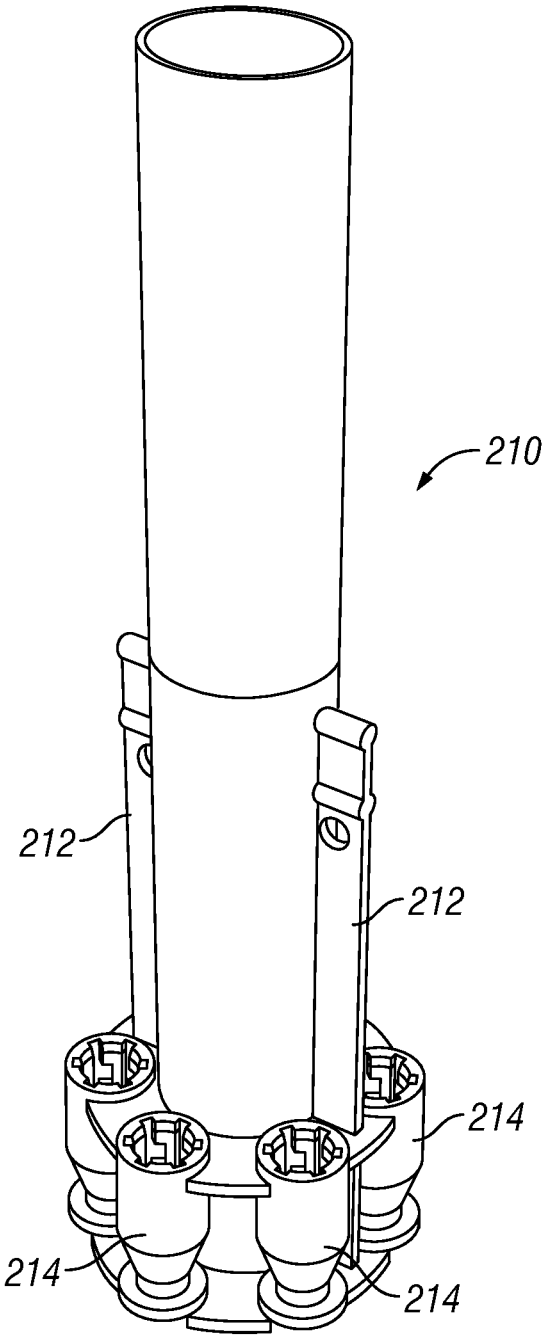
FIG. 3 shows a portion of the connection system shown in FIG. 2.
Figure 4:
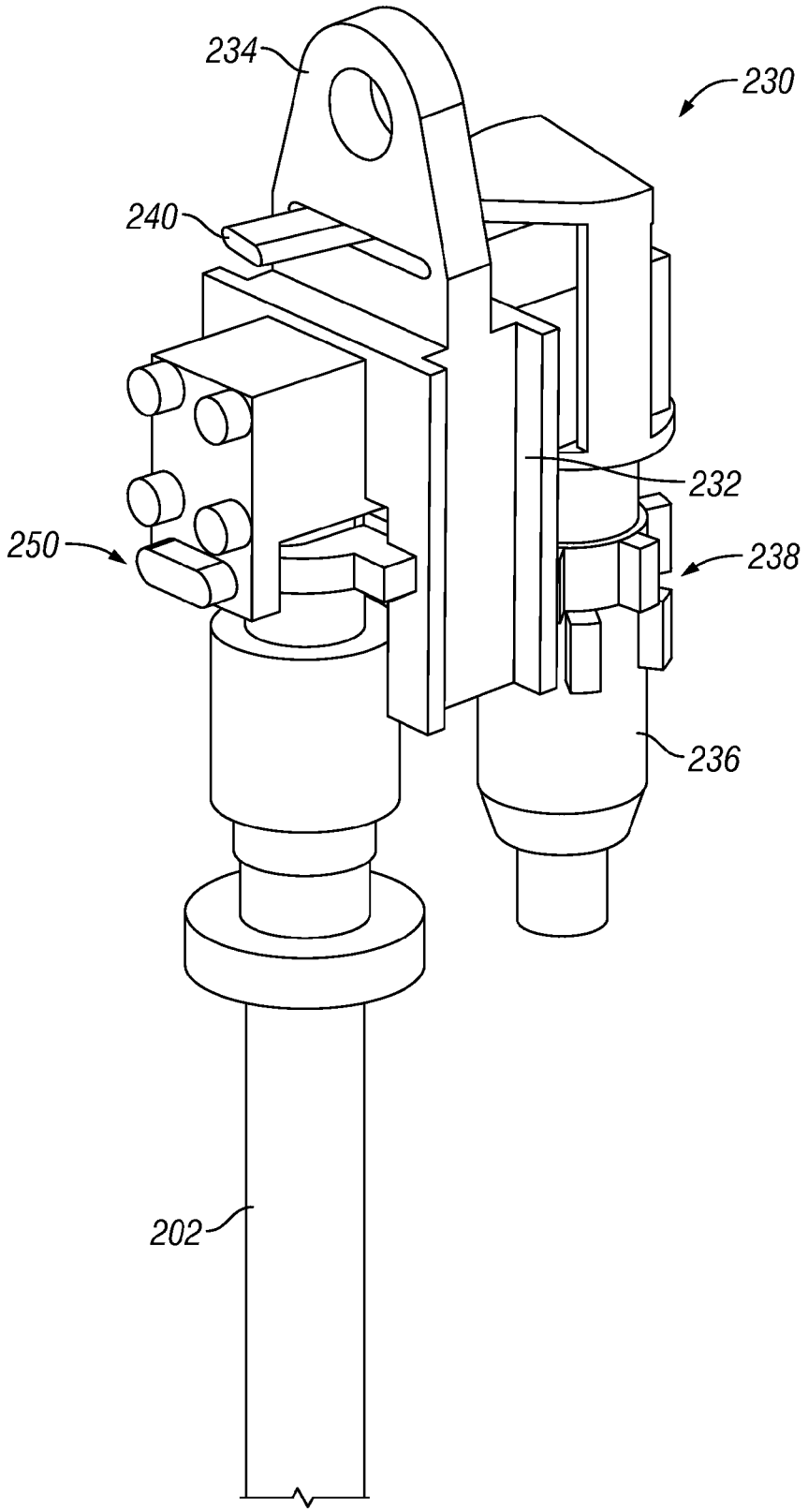
FIG. 4 shows a gooseneck used in the embodiment of the connection system shown in FIG. 2.

As shown in FIGS. 2 and 3, the connection system 200 includes a connector 210 attachable to the subsea riser 206, either as a structural component of the riser 206 itself or as a body attachable to the outside of the riser 206. The connector 210 includes a tube or sleeve mounted to the portion of the telescoping joint connected with the riser 206 extending subsea. Thus, the offshore structure is potentially moving relative to the riser 206 and the connector 210. In addition to the functions described below, the connector 210 is also useful in protecting the covered portion of the riser 206.

Shown more clearly in FIG. 3, the connector 210 includes a hang off structure. Although other hang off structures may be used, in the embodiment shown the hang off structure includes two hang off bars or guides 212. The guides 212 extend radially from and run vertically along a portion of the outside of the connector 210. The guides 212 also include an engagement for a locking mechanism, in this case a through-hole, that will be described further below. The guides 212 are either integral with or connected to the connector 210, such as by bolting or welding, in a way to support a load placed on the guides 212. Although two guides 212 are shown, any number of guides may be used, including one. Near the lower portion of and spaced around the connector 210 are one or more riser fluid line connectors 214. As shown in this embodiment, each of the riser fluid line connectors 214 aligns with and is connected to a riser fluid line 204. However, the riser fluid line connectors 214 do not necessarily need to connect with a riser fluid line 204 and may be included for efficiency in manufacturing regardless of whether they are necessarily being used to connect to a riser fluid line 204 in every installation. Use of the riser fluid line connectors 214 is described further below.

As shown in FIGS. 2 and 4-6, the embodiment of the connection system 200 further includes one or more goosenecks 230 that are used to establish or break fluid communication between the structure fluid line 202 and the riser fluid line 204. Each gooseneck 230 includes body 232 with a lift point 234 for engaging and lifting the gooseneck 230. In the embodiment shown, the lift point 234 includes a through-hole the use of which will be described further below. Each gooseneck 230 also includes a gooseneck connector 236 in fluid communication with the corresponding structure fluid line 202. The gooseneck connector 236 is configured to connect with a corresponding riser fluid line connector 214 to establish fluid communication between the structure fluid line 202 and a corresponding riser fluid line 204. The connection may be any suitable connection, such as a wet or dry stab connection or other type of connection.

Each gooseneck 230 further includes two locking mechanisms. The first locking mechanism is used to lock the gooseneck in place when connected with the riser fluid line connector 214 and may be any suitable type of locking mechanism. In this embodiment, the first locking mechanism includes a twist lock 238 controlled by a twist lock indicator 240. Moving the twist lock indicator 240 back and forth engages and disengages the twist lock 238 from a riser fluid line connector 214. The twist lock indicator 240 also may provide a visual indication of whether the twist lock 238 is in the engaged or disengaged position.

Figure 11:
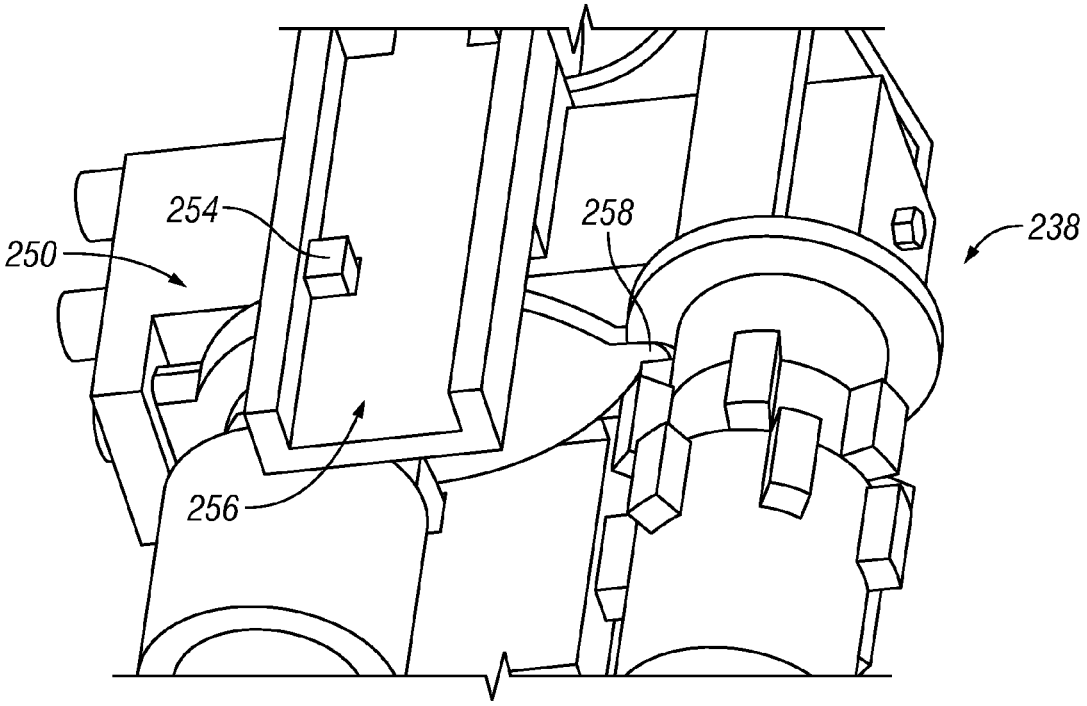
FIG. 11 shows a portion of the connection system shown in FIG. 2.
Figure 12:
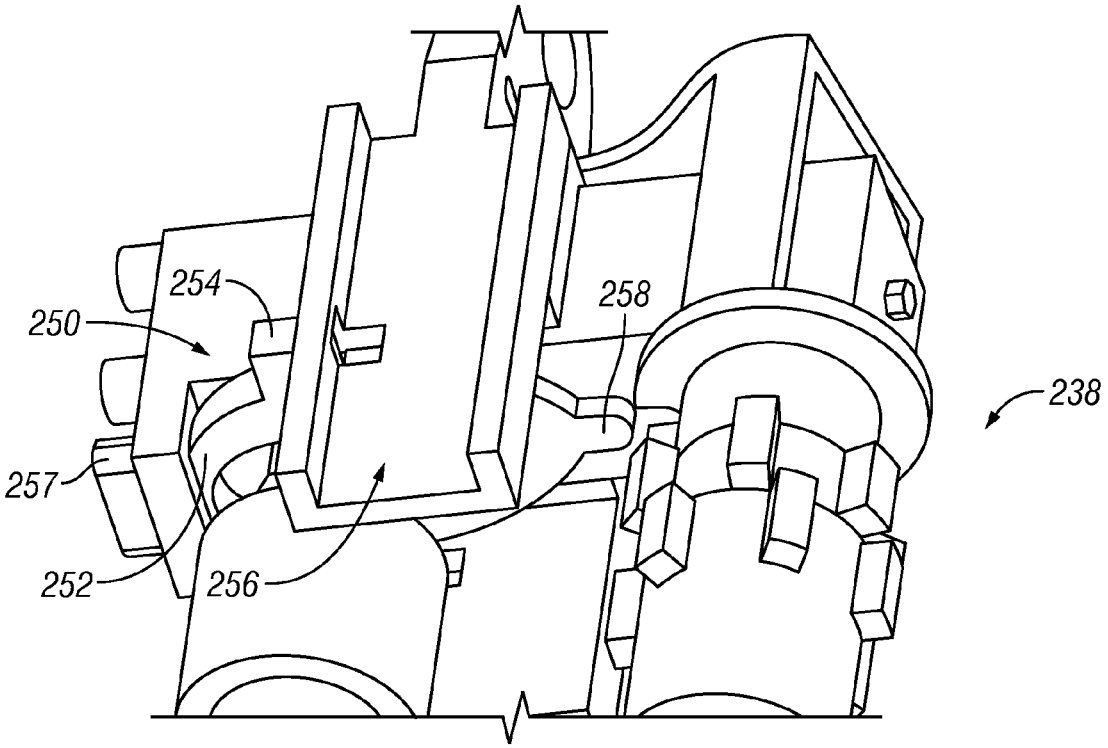
FIG. 12 shows a portion of the connection system shown in FIG. 2.

Shown more clearly in FIGS. 11 and 12, the second locking mechanism is a safety lock 250 that includes a slidable body 252 with a tab 254 extending from one side, or tabs 254 extending from both sides and into a channel or channels 256 on the side of the gooseneck body 232. The body 252 also includes a safety lock indicator 257 extendable from the body 252 as the safety lock 250 is disengaged. Opposite the indicator 257 is a locking tab 258 that engages a slot in the twist lock 238 to allow or prevent rotation of the twist lock 238. The safety lock 250 is biased into a locked position with the locking tab 258 engaged to prevent twisting of the twist lock 238. More on the operation of the safety lock 250 is described below.

Figure 5:
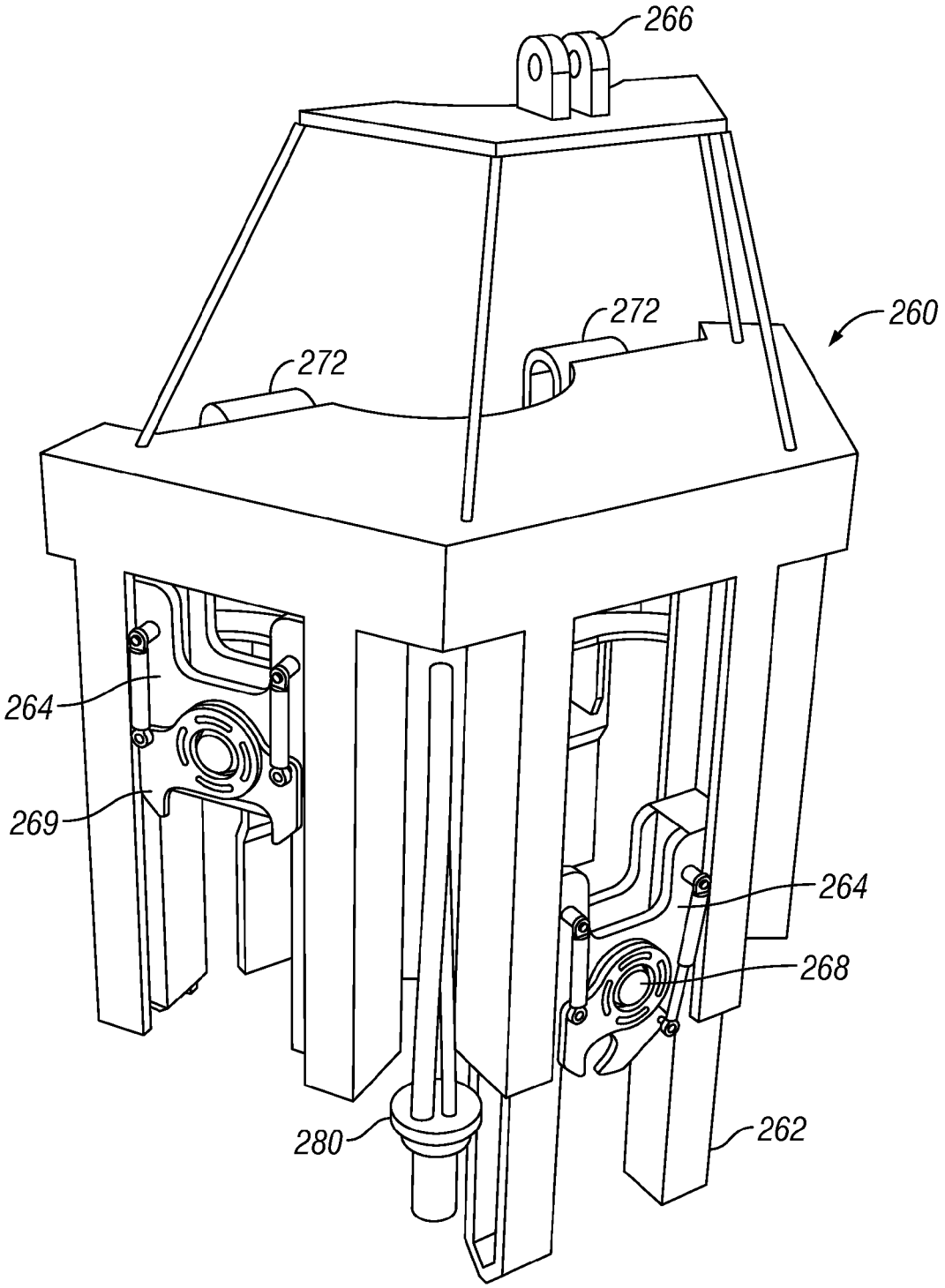
FIG. 5 shows a portion of the connection system shown in FIG. 2.

As shown in FIGS. 5-9, the embodiment of the connection system 200 further includes a frame 260 that includes one or more vertical guides 262. Moveable within each guide 262 is a slide 264 that is releasably engageable with each gooseneck 230 as shown more clearly in FIGS. 2 and 6. As shown in FIG. 5, slide(s) 264 are moveable within the guides 262 for moving the gooseneck(s) 230 into and out of a connected position with the riser fluid line connectors 214 as described further below. The frame 260 is suspendable from a lift point 266 from any suitable installation system 290 as further described below. The slide(s) 264 include an engageable connector 268 (FIG. 7) for releasably engaging the gooseneck lift point 234. The connector 268 may be any suitable type of connector, such as a locking bolt. Each slide 264 also includes a lock activator 269 with arms that engage the twist lock indicator 240 on the gooseneck 230 to engage or disengage the twist lock 238.

Figure 6:
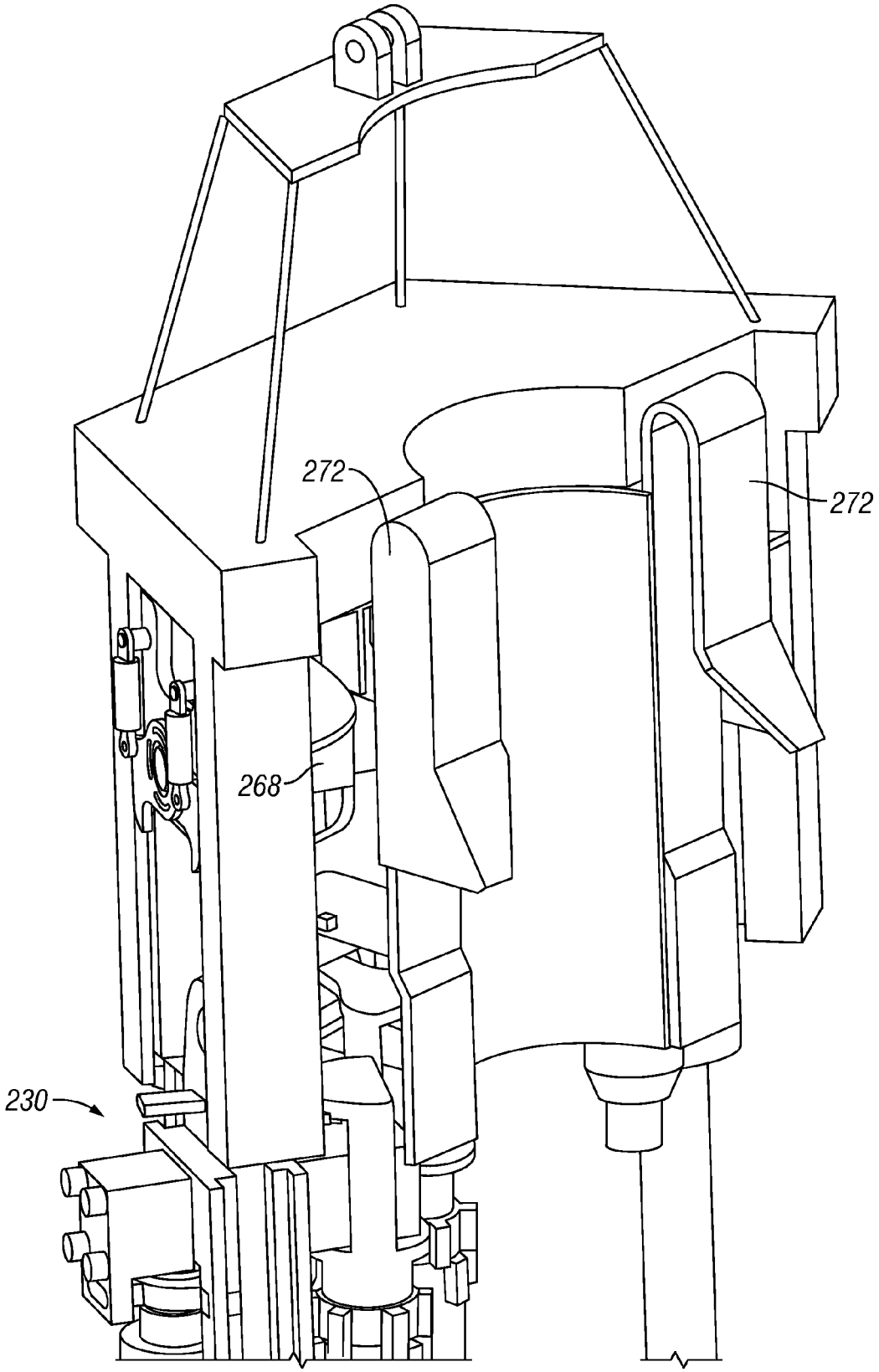
FIG. 6 shows a portion of the connection system shown in FIG. 2.
Figure 7:
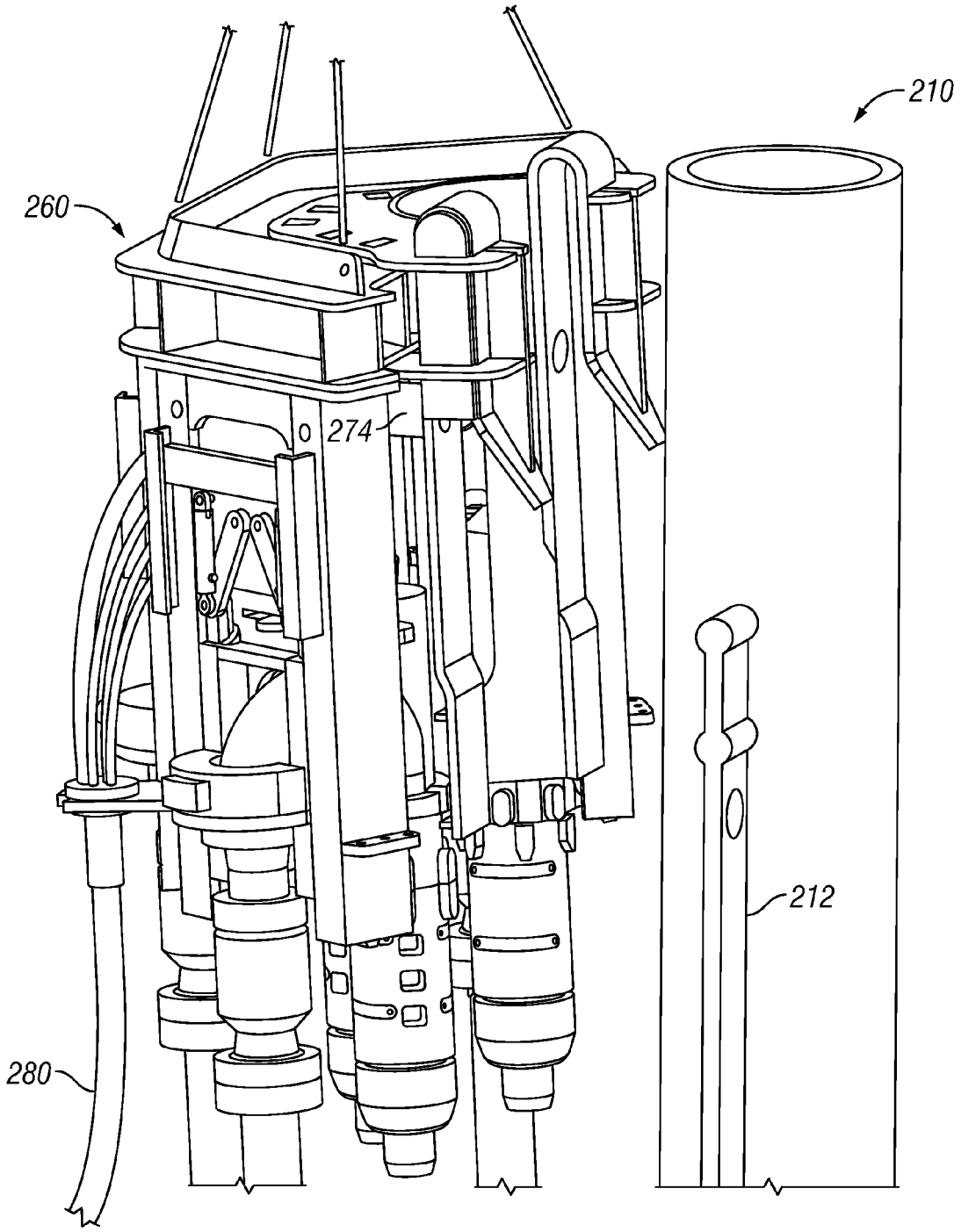
FIG. 7 shows a portion of the connection system shown in FIG. 2.
Figure 8:
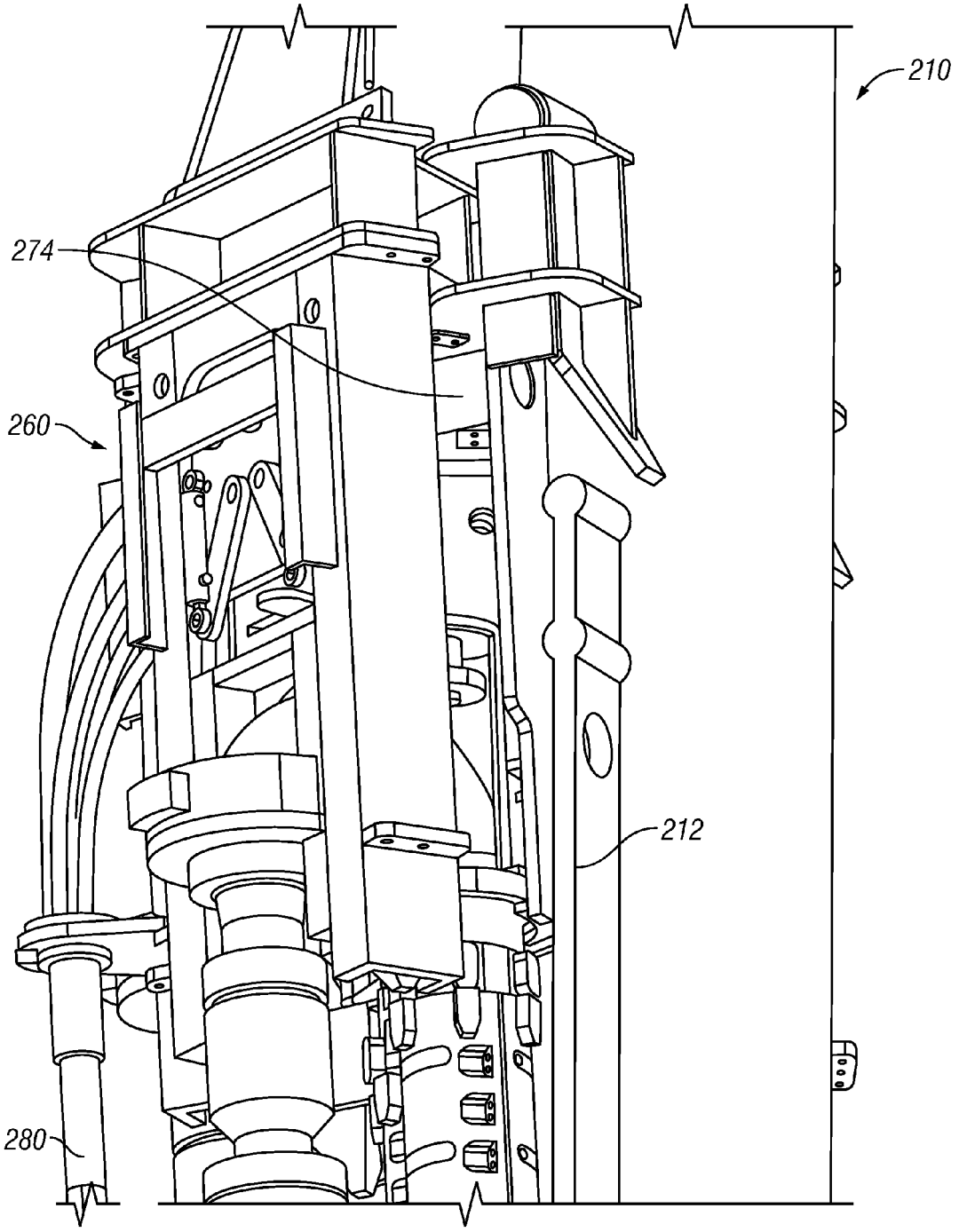
FIG. 8 shows a portion of the connection system shown in FIG. 2.
Figure 9:
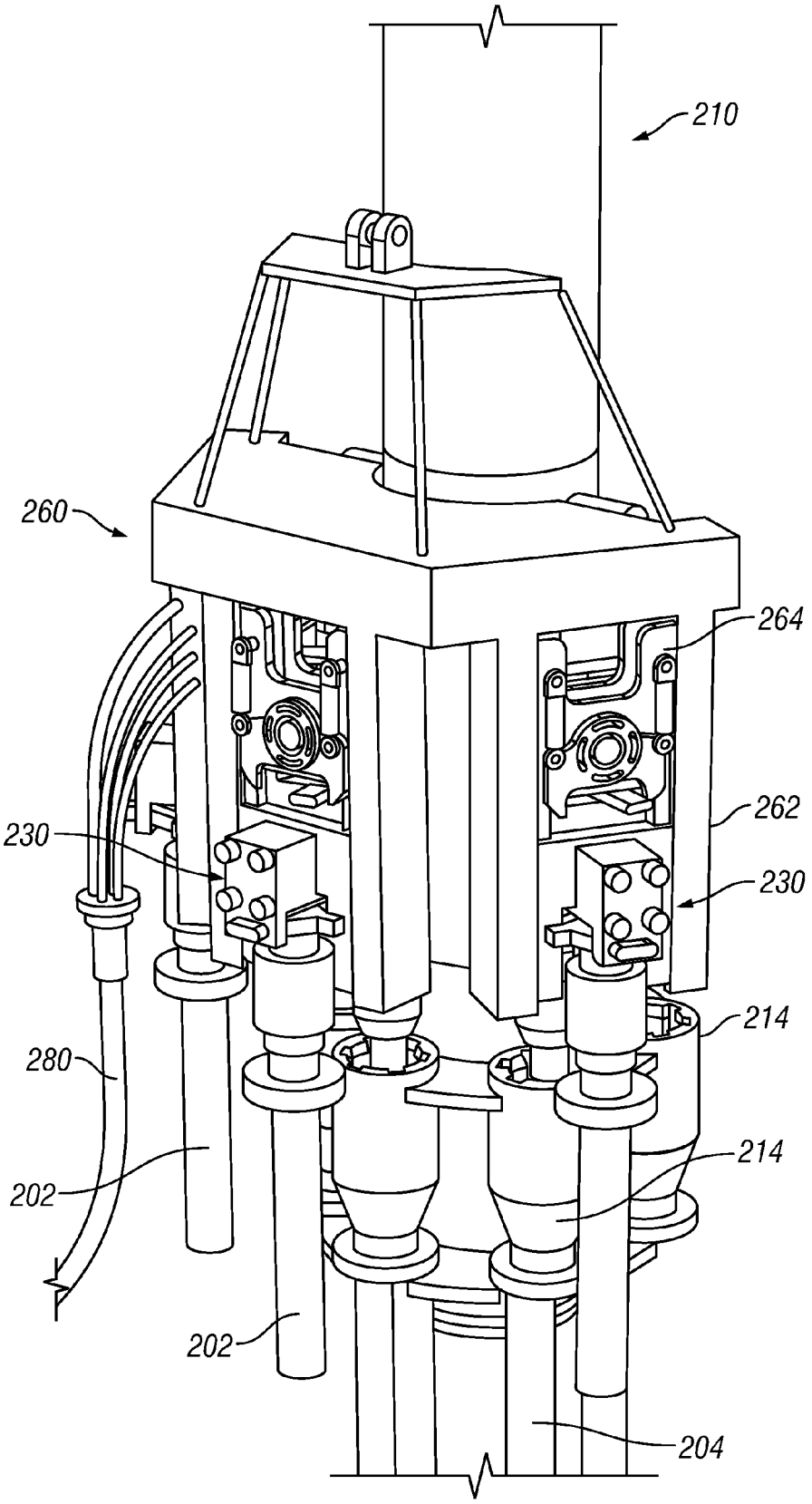
FIG. 9 shows a portion of the connection system shown in FIG. 2.

As shown more clearly in FIGS. 5-8, the frame 260 also includes a hang off frame to support the frame 260 on the connector hang off structure. In this embodiment, the hang off frame includes alignment funnels 272 that fit over the guides 212 of the connector 210 and allow the frame 260 to be fully supported on the connector 210. As mentioned above, the frame 260 also includes a locking mechanism to lock the frame 260 to the hang off structure of the connector 210. In this embodiment, the locking mechanism includes a locking bolt arrangement but it should be appreciated that any suitable locking mechanism may be used. As shown in FIGS. 5-7, the frame 260 may also include an inner profile that compliments an outer profile of the connector 210 so that the frame 260 may be further aligned with the connector 210 when engaging the hang off structure as shown in FIGS. 7-9.

As shown in FIGS. 2,5, and 7-9, the connection system 200 further includes at least one control umbilical 280 that extends from the frame 260 to a remote control system located on the offshore structure. The control umbilical 280 includes hydraulic and electric communication lines that communicate with valves and hydraulic lines on the frame 260 to control the position of the slides 264 within the frame 260. The remote control system is in communication with the slides 264 through the control umbilical 280 and may include any suitable type of control system, including manually operated, automatic, or computerized. The control system and control umbilical allow for the remote control operation of the connection system 200, avoiding the necessity of personnel having to make up fluid line connections by hand.

To move the frame 260 into the landed position on the connector 210, the connection system 200 may further include an installation system 290. Any suitable installation system may be used for moving the frame 260 and is not specific to any type of offshore structure and does not need to be specialized just for moving the frame 260. As shown in this embodiment, the installation system 290 includes one or more cranes 292 with an arm that lifts and lowers, extends and retracts, and rotates to position the frame 260 onto the connector 210.

As shown in FIG. 2, it should be appreciated that one or any number of frames 260 may be used. Any number of installation systems 290 may also be used. In the embodiment shown, two frames 260 and two installation systems 290 are used, with each frame 260 including a control umbilical 280. When one frame 260 is being used to connect structure fluid lines 202 with the riser fluid lines 204, the second frame 260 may be parked on a parking station similar in structure to the hang off structure of the connector 210. On the parking structure, the goosenecks 250 may be connected with the slides 264 and the control system may test and position the slides 264 before installation onto the connector 210.

Referring to FIGS. 2 and 6-12, an example installation sequence for the connection system 200 will be described. As shown in FIG. 2, the connector 210 is installed with the riser 206 and the riser fluid line connectors 214 are connected with the riser fluid lines 204. The gooseneck(s) 230 are also made up with the structure fluid line(s) 202. With a frame 260 parked on the structure, the appropriate number of goosenecks 230 are placed in the guides 262 of the frame 260. The slides 264 are engaged with the goosenecks 230 and the slide engageable connector 268 engaged with the gooseneck lift point 234. Positioning the goosenecks 230 within the frame 260 disengages the safety lock 250 as the frame 260 or slide 264 move over the gooseneck channel 256 and push the tab 254 and the safety lock body 252 forward, disengaging the safety locking tab 258 from the twist lock 238. The gooseneck twist lock 238 may be in the unlocked position. The control system may optionally communicate with the frame 260 to test the operation of the slides 264 as well as the lock activator 269 before the frame 260 is moved into position with the connector 210.

The installation system 290 may then lift a frame 260 along with the goosenecks 230 and structure fluid lines 202 and move the frame 260 into a landed position on the connector 210. As shown in FIGS. 7 and 8 specifically, in this embodiment, the alignment funnels 272 are positioned above the guides 212 with the connector 210 outer profile fit within the inner profile of the frame 260. The frame 260 is then landed on the guides 212 and locked into position so that the frame 260 moves with the connector 210, and thus the riser 206. With the frame 260 landed and locked to the connector 210, the control system may then be used to remotely move the goosenecks 230, and more specifically the gooseneck connectors 236 into a connected position to establish fluid communication between the structure fluid lines 202 and the riser fluid lines 204. This may be done by controlling hydraulic fluid through the control umbilical 280 to lower the slides 264 and stab the gooseneck connectors 236 into riser fluid line connectors 214. The goosenecks 230 may be connected one at a time or all at once.

Figure 10:
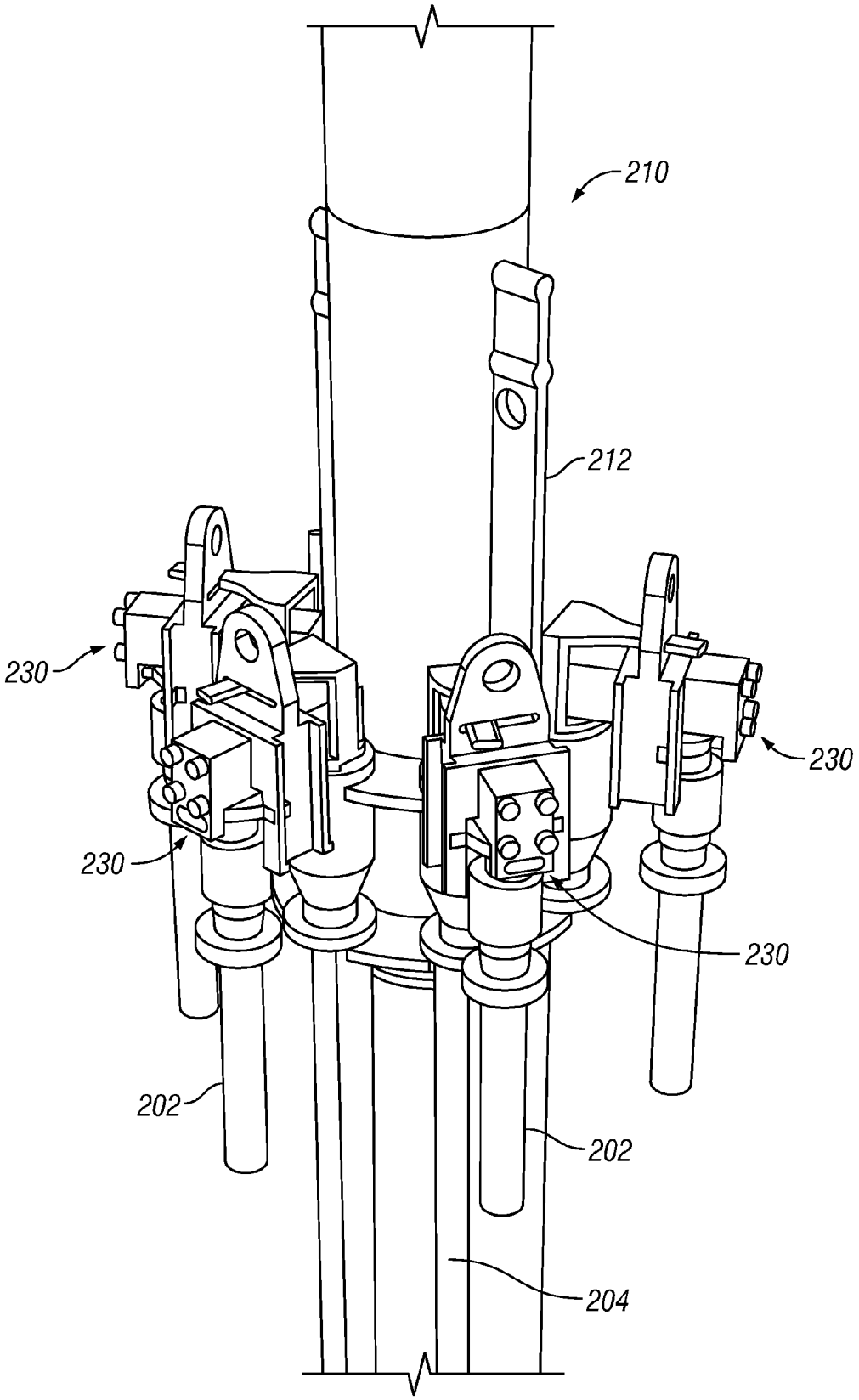
FIG. 10 shows a portion of the connection system shown in FIG. 2.

Once the goosenecks 230 are connected to establish fluid communication with the riser fluid lines 204, the lock activators 269 are controlled to engage the twist lock indicator 240 and move the twist lock 238 into the engaged position, locking the goosenecks 230 to the riser fluid line connectors 214. The engageable connectors 268 on the slides 264 are then controlled to release the goosenecks 230 from the slides 264. The slides 264 are then raised within the guides 262 to separate from the goosenecks 230. The frame 260 is then unlocked from the guides 212 and the installation system 290 operated to lift the frame 260 off and away from the guides 212. The goosenecks 230 are thus left connecting the structure fluid lines 202 with the riser fluid lines 204 as shown in FIG. 10. As the slide 264 is removed from the goosenecks 230, the gooseneck safety locks 250 are disengaged and returned to the locked position shown in FIG. 11, preventing the twist locks 238 from moving out of their locked position with the riser fluid line connectors 214. In this manner, moving the frame 260 away from the connector 210 removes all of the hydraulic and electric control lines from the splash zone where they may otherwise be damaged or be in the way of other equipment.

If additional structure fluid lines 202 need to be connected with riser fluid lines 204, the process may be repeated using the same or a different frame 260. A similar procedure but in reverse may also be used to disengage the structure fluid lines 202 from the riser fluid lines 204 and remove the goosenecks 230 from the splash zone.

It should also be appreciated that although the connection system 200 is designed for remote control operation, the goosenecks 230 may also be installed by hand if desired.

Although the present invention has been described with respect to specific details, it is not intended that such details should be regarded as limitations on the scope of the invention, except to the extent that they are included in the accompanying claims.

What is claimed is:

1. A connection system for connecting a structure fluid line on an offshore structure with a riser fluid line on a subsea riser, the system comprising:

a connector attachable to the subsea riser;

a gooseneck comprising a gooseneck connector connectable in fluid communication with the structure fluid line;

a frame supportable on the connector, the frame comprising a slide releasably engageable with the gooseneck and moveable within the frame; and wherein the slide is remotely controllable to move the gooseneck connector into and out of a connected position to establish or break fluid communication between the structure fluid line and the riser fluid line.

2. The system of claim 1 wherein the connector comprises a connector hang off structure and the frame comprises a hang off frame to support the frame on the connector hang off structure.

3. The system of claim 1 wherein the connector comprises a riser fluid line connector in fluid communication with the riser fluid line.

4. The system of claim 1 further comprising multiple structure fluid lines, multiple riser fluid lines, multiple goosenecks, and multiple slides, the slides remotely controllable to move the goosenecks within the frame.

5. The system of claim 1 further comprising a control umbilical to control the position of the slide within the frame.

6. The system of claim 5 further comprising a control system in communication with the slide through the control umbilical.

7. The system of claim 1 further comprising more than one frame and more than one control umbilical.

8. The system of claim 1 wherein the slide is disconnectable from the gooseneck and the frame is removable from the connector with the structure fluid line in fluid communication with the riser fluid line.

9. The system of claim 1 further comprising an installation system to move the frame into supported connection with the connector.

10. The system of claim 1 wherein the gooseneck comprises a lock to lock the gooseneck in the connected position.

11. A method for connecting a structure fluid line on an offshore structure with a riser fluid line on a subsea riser, the method comprising:

connecting a gooseneck assembly to a frame, the gooseneck assembly being in fluid communication with the structure fluid line, wherein the frame comprises a slide releasably engageable with the gooseneck assembly and moveable within the frame;

connecting the frame and the connected gooseneck assembly to the subsea riser; and establishing fluid communication between the structure fluid line and the riser fluid line.

12. The method of claim 11, further comprising disconnecting the frame from the gooseneck assembly.

13. The method of claim 12, wherein the slide is remotely controllable to place the gooseneck assembly into and out of a connected position to establish or break fluid communication between the structure fluid line and the riser fluid line.

14. The method of claim 11, wherein the frame connects to a connector attached to the subsea riser.

15. The method of claim 14, wherein the connector comprises a connector hang off structure and the frame comprises a hang off frame to support the frame on the connector hang off structure.

16. The method of claim 11, wherein the gooseneck assembly comprises a lock to lock the gooseneck in a connected position.

17. The method of claim 16, further comprising actuating the lock by twisting.

* * * * *